US008875370B2

(12) United States Patent
Kunita et al.

(10) Patent No.: US 8,875,370 B2
(45) Date of Patent: Nov. 4, 2014

(54) PANEL LOADING METHOD AND PANEL-LOADING SUPPORT DEVICE

(75) Inventors: Hideo Kunita, Tochigi-ken (JP); Tetsuji Nakashima, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 426 days.

(21) Appl. No.: 13/010,374

(22) Filed: Jan. 20, 2011

(65) Prior Publication Data

US 2011/0179629 A1 Jul. 28, 2011

(30) Foreign Application Priority Data

Jan. 27, 2010 (JP) ..... 2010-015048

(51) Int. Cl.
*B21D 39/02* (2006.01)
*B21D 43/00* (2006.01)

(52) U.S. Cl.
CPC ..... *B21D 39/021* (2013.01); *B21D 43/003* (2013.01)
USPC ..... 29/428; 29/243.5; 29/468; 72/316; 72/420

(58) Field of Classification Search
CPC ..... B21D 39/021
USPC ..... 29/509, 513, 505, 514, 428, 243.5, 29/243.57, 243.58, 243.53, 243.56, 450, 29/468; 72/306, 312–323, 419–428
See application file for complete search history.

(56) References Cited

U.S. PATENT DOCUMENTS

| | | | | |
|---|---|---|---|---|
| 6,477,880 | B1 * | 11/2002 | Zimmer | 72/323 |
| 2004/0040135 | A1 * | 3/2004 | Campian | 29/243.58 |
| 2006/0037377 | A1 * | 2/2006 | Wiens et al. | 72/312 |
| 2007/0193325 | A1 * | 8/2007 | Matsumoto | 72/312 |

FOREIGN PATENT DOCUMENTS

| | | |
|---|---|---|
| JP | 11-333535 | 12/1999 |

* cited by examiner

*Primary Examiner* — Alexander P Taousakis
*Assistant Examiner* — Steven A Maynard
(74) *Attorney, Agent, or Firm* — Rankin, Hill & Clark LLP

(57) ABSTRACT

A panel loading method for loading an inner panel to an outer panel that has a bent portion provided by bending a periphery thereof, the outer panel and the inner panel being overlapped to integrate the outer panel and the inner panel at the periphery thereof. The method includes: providing at least one of the outer panel and the inner panel by an elastic body; disposing the outer panel onto a panel receiver so that the bent portion is directed upward; placing a guide plate on or above the bent portion; loading the inner panel into the outer panel from above the guide plate; and inserting the inner panel into an inside of the bent portion.

2 Claims, 19 Drawing Sheets

PANEL LOADING METHOD AND PANEL-LOADING SUPPORT DEVICE

CROSS-REFERENCE TO RELATED APPLICATION

This application is based upon and claims the benefit of priority from Japanese Patent Application No. 2010-015048 filed on Jan. 27, 2010, of which the contents are incorporated herein by reference.

BACKGROUND OF THE INVENTION

1. Field of the Invention

The present invention relates to a panel loading method for loading an inner panel to an outer panel and a panel-loading support device.

2. Description of the Related Art

A method for loading a workpiece to a hemming machine disclosed in Japanese Patent No. 3634149 employs a plurality of grippers $\mathbf{82}_1$, $\mathbf{82}_2$ and $\mathbf{82}_3$ suspended from a robot hand 81. The grippers $\mathbf{82}_1$, $\mathbf{82}_2$ and $\mathbf{82}_3$ grip bent peripheries WOe of a plurality of circumferential sides of outer members WRO and WLO to load workpieces WR and WL onto the hemming machine. Specifically, each of the grippers $\mathbf{82}_1$, $\mathbf{82}_2$ and $\mathbf{82}_3$ has a pair of gripper claws 82*b* and 82*c*, one of the gripper claws 82*b* and 82*c* having a projection 82*d* and the other of the gripper claws 82*b* and 82*c* having a recess 82*e*. The bent peripheries WOe of the outer members WRO and WLO are gripped between the projection 82*d* and the recess 82*e* to be partially deformed. When the bent peripheries WOe of respective sides WOa, WOc and WOd of the outer members WRO and WLO are gripped by the grippers $\mathbf{82}_1$, $\mathbf{82}_2$ and $\mathbf{82}_3$, the (inner) gripper claw 82*b* also serves as a workpiece retainer for preventing the uplift of the inner members WRI and WLI, thereby preventing misalignment of the inner members WRI and WLI relative to the outer members WRO and WLO in loading the workpiece onto the hemming machine. After loading the workpiece, the workpiece is hemmed.

Though the workpiece is loaded after the outer panel and the inner panel are overlapped, when a parting line of the panel comes to a side orthogonal to a loading direction as shown in FIG. 17, a bent portion (hemming flange) 104 that is bent at the periphery of the outer panel 100 interferes with an end of the inner panel 102 in the setting path of the inner panel 102 when the outer panel 100 and the inner panel 102 are overlapped.

In order to avoid such an interference, an end of the inner panel 102 are cut off as shown in FIG. 18 or the outer panel 100 are pulled and stretched by a sucker 106.

However, when an end of the inner panel 102 is cut off, an engagement length for hemming is reduced, so that fastening strength and, consequently, the accuracy and rigidity of the hemming are reduced. Specifically, since the outer panel 100 are folded back to hold the inner panel 102 to fasten the plate members during the hemming, when an end of the inner panel 102 is cut off, the fastening strength is lowered to cause a misalignment of the inner panel 102 and the outer panel 100, resulting in decrease in the processing accuracy. When the outer panel 100 is pulled by a sucker, the outer panel 100 may not be sufficiently stretched depending on the shape and rigidity of the outer panel 100. The technique disclosed in the above Japanese Patent No. 3634149 does not overcome the above deficiencies.

SUMMARY OF THE INVENTION

The present invention has been made in view of the above conventional problems. An object of the invention is to provide a panel loading method that allows an inner panel to be easily loaded to an outer panel having a bent portion provided by bending a periphery thereof, without lowering the hemming processing accuracy, and a panel-loading support device.

In order to attain the above object, a panel loading method according to an aspect of the invention is for loading an inner panel to an outer panel that has a bent portion provided by bending a periphery thereof, the outer panel and the inner panel being overlapped to integrate the outer panel and the inner panel at the peripheries thereof, the method including: providing at least one of the outer panel and the inner panel by an elastic body; placing the outer panel on a panel receiver so that the bent portion is directed upward; placing a guide plate on or above the bent portion; loading the inner panel to the outer panel from above the guide plate; and inserting the inner panel into an inside of the bent portion of the outer panel.

The method may further comprises: moving the outer panel and the inner panel upward; and, when the outer panel and the inner panel are moved upward, retreating the guide plate from a path of the outer panel and the inner panel in accordance with the upward movement of the outer panel and the inner panel.

In order to attain the above object, a panel-loading support device is used for loading an inner panel to an outer panel that has a bent portion provided by bending a periphery thereof, the outer panel and the inner panel being overlapped to integrate the outer panel and the inner panel at the peripheries thereof, the device including: a panel receiver on which the outer panel is placed so that the bent portion is directed upward and is located at a predetermined point; and a guide plate that is placed on or above the predetermined point.

In the above structure, the inner panel may be loaded to the outer panel by a downward movement of the inner panel from above the guide plate toward the outer panel placed on the panel receiver, the inner panel being inserted into an inside of the bent portion of the outer panel with an aid of the guide plate.

Further, the device may further include: a guide plate fixing portion that fixes an end of the guide plate so that the other end of the guide plate is placed on or above the predetermined point, in which the guide plate fixing portion comprises a rotary shaft and is rotated around the rotary shaft by a force applied on the guide plate in accordance with the upward movement of the outer panel and the inner panel.

According to the above aspect of the invention, by placing the outer panel on the panel receiver such that the bent portion is positioned on the upper side; placing the guide plate on the bent portion; and loading the inner panel onto the outer panel from above the guide plate, the inner panel can be easily loaded to the outer panel having a bent portion without impairing the accuracy and strength of the hemming.

Further, even when the bent angle of the bent portion of the outer panel is so acute that it is difficult to load the inner panel, the inner panel can be easily loaded. Furthermore, the inner panel can be loaded to the outer panel without damaging the outer panel and the inner panel.

When the overlapped outer panel and inner panel are moved upward from the panel-loading support device to be removed, the guide plate is retreated from the path of the outer panel and the inner panel. Accordingly, the outer panel and the inner panel can be easily removed.

The above and other objects features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

A preferred embodiment of a panel-loading support device as well as a panel loading method implemented using the panel-loading support device according to the invention will be descried below in detail with reference to the attached drawings.

Figure 1:
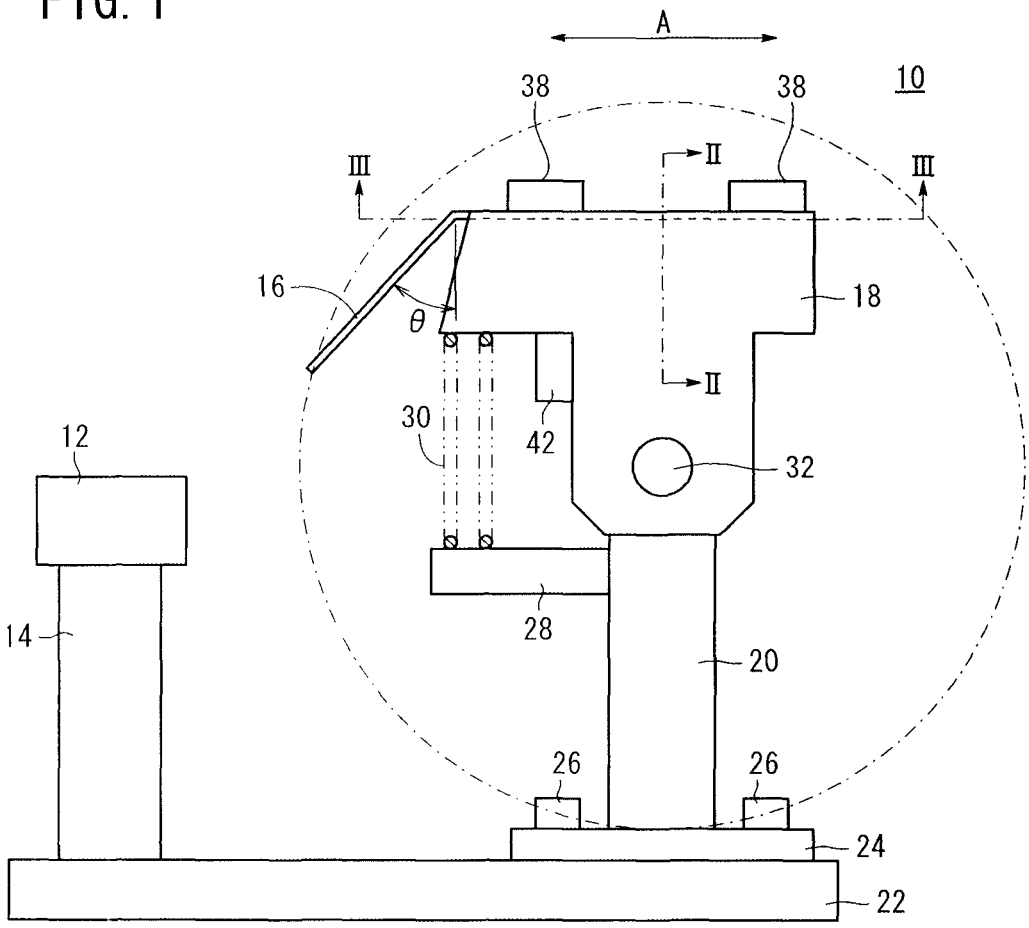
FIG. 1 is a front elevational view showing an arrangement of a panel-loading support device according to an embodiment of the invention.
Figure 2:
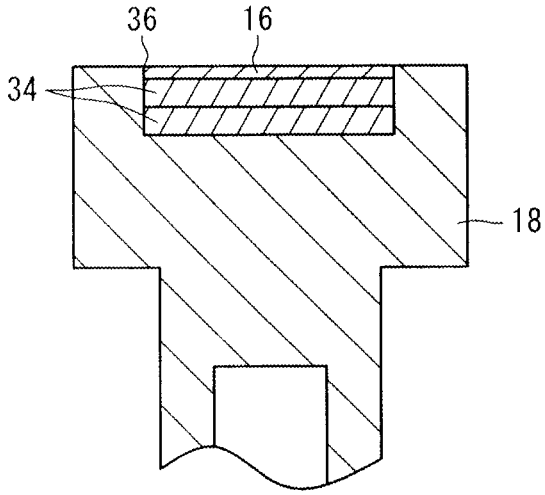
FIG. 2 is a partial, cross-sectional view of the panel-loading support device taken along II-II line in FIG. 1.
Figure 3:
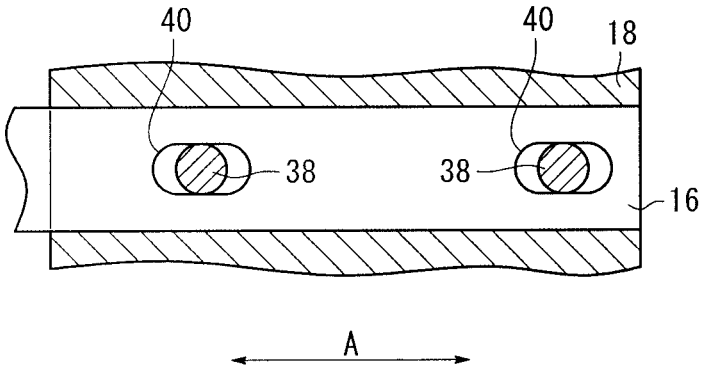
FIG. 3 is another partial, cross-sectional view of the panel-loading support device taken along line in FIG. 1.

FIG. 1 is a front elevational view showing an arrangement of a panel-loading support device 10. FIG. 2 shows a part of a cross section of the panel-loading support device 10 taken along II-II line in FIG. 1. FIG. 3 shows another cross section of the panel-loading support device 10 taken along III-III line in FIG. 1. The panel-loading support device 10 includes: a panel receiver 12 on which an outer panel is placed; a first support 14 for supporting the panel receiver 12; a guide plate 16; a guide plate fixing portion 18 on which the guide plate 16 is fixed; a second support 20 for supporting the guide plate fixing portion 18; and a base 22 as a base portion of the panel-loading support device 10. Incidentally, in the following description, right and left, and up (upper) and down (lower) directions are respectively defined by right and left, and upper and lower directions of the panel-loading support device 10 in the front elevational view of FIG. 1.

The first support 14 and the second support 20 are collinearly provided on the base 22. The first support 14 is attached to the base 22 by a bolt (not shown). The second support 20 has a flange 24, the flange 24 and the base 22 being attached by bolts 26, 26. The guide plate fixing portion 18 has a substantially T-shape in front view. The guide plate fixing portion 18 and a stay 28 that horizontally projects from the second support 20 vertically fixes a spring 30.

The guide plate fixing portion 18 fixes a second end of the guide plate 16 provided by an elastic body so that a first end of the guide plate 16 is disposed at or above a predetermined point. The first end of the guide plate 16 that projects from the guide plate fixing portion 18 to the panel receiver 12 extends from an upper surface of the guide plate fixing portion 18 toward the predetermined point at a lower left side. The predetermined point refers to a position of a bent portion of an outer panel having the bent portion formed by bending a periphery thereof when the outer panel is placed on the panel receiver 12 so that the bent portion is directed upward. The outer panel is placed on the panel receiver 12 so that the bent portion is situated at the predetermined point and is directed upward.

The guide plate fixing portion 18 is pivotally supported by the second support 20 around a rotary shaft 32. The second support 20 has a stopper 42 that blocks the rotation of the guide plate fixing portion 18 toward a side at which the panel receiver 12 is provided. The fixing portion 18 illustrated in FIG. 1 is not applied with a force (neutral state). At this time, no force is applied against the spring 30. When more than a predetermined level of a rightward force (i.e. a force in a direction away from the panel receiver 12) is applied on the guide plate fixing portion 18, the guide plate fixing portion 18 rotates rightward around the rotary shaft 32. When the guide plate fixing portion 18 rotates rightward around the rotary shaft 32, the spring 30 is stretched to generate a contraction force so as to restore the state of the guide plate fixing portion 18 to the state shown in FIG. 1.

The angle θ for the first end of the guide plate 16 to extend downward can be set as desired. As shown in FIG. 2, a recess 36 for accommodating an adjuster plate 34 for adjusting the height of the second end of the guide plate 16 is provided on the top side of the guide plate fixing portion 18. Though two adjuster plates 34 are inserted into the recess 36 in FIG. 2, the number of the adjuster plate 34 may be altered as desired.

The second end of the guide plate 16 is fixed on the top surface of the guide plate fixing portion 18 by bolts 38, 38. As shown in FIG. 3, the guide plate 16 has elliptical holes 40, 40. The shafts of the bolts 38, 38 are inserted into the holes 40, 40 to fix the guide plate 16 on the top surface of the guide plate fixing portion 18. The elliptical configuration of the holes 40, 40 allows a fine adjustment of the guide plate 16 in A direction (i.e. a longitudinal direction of the guide plate 16). Incidentally, each of the bolts 38 includes a shaft and a head.

Further, though the circle shown in a dashed line in FIG. 1 represents a path of the first end of the guide plate 16 when the guide plate 16 is rotated by 360 degrees around the rotary shaft 32, the guide plate fixing portion 18 does not actually rotate by 360 degrees.

Next, an operation of the panel-loading support device 10 will be described below. The outer panel 52 is placed on the panel receiver 12 by an industrial robot or a manual labor so that the bent portion 50 provided by bending a periphery of the outer panel 52 is directed upward. Specifically, the outer panel 52 is placed on the panel receiver 12 so that the bent portion 50 is located at the predetermined point and is directed upward.

Figure 4:
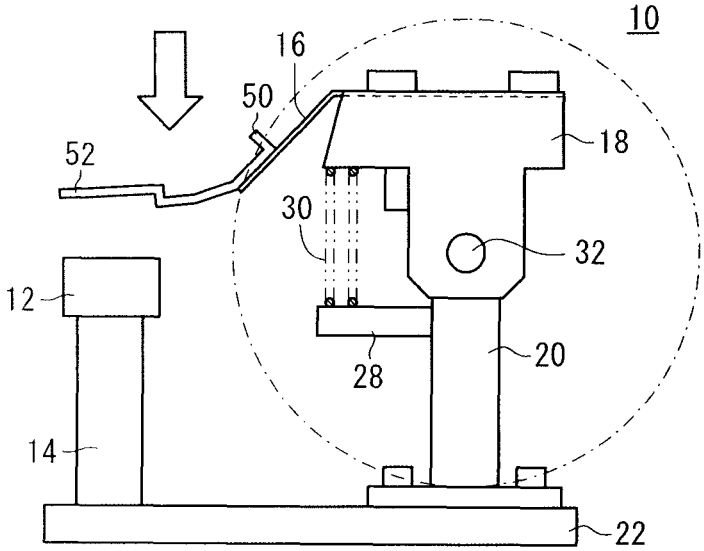
FIG. 4 is a view showing an operation of the panel-loading support device for placing an outer panel on a panel receiver by an industrial robot or a manual labor.
Figure 5:
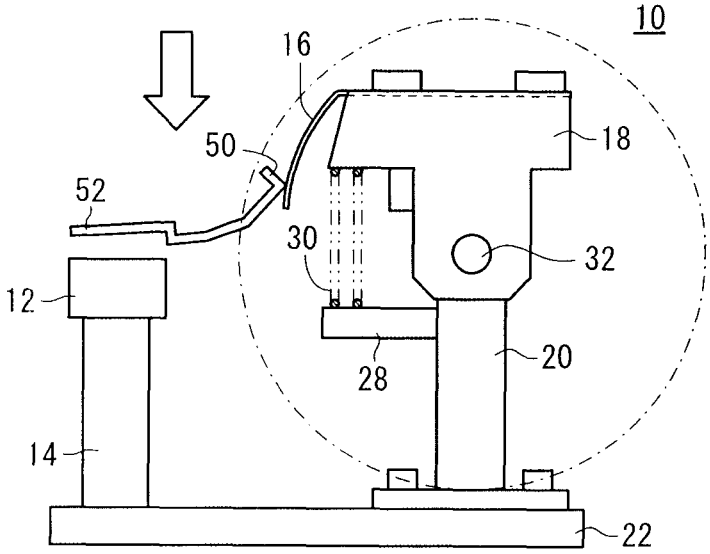
FIG. 5 is a view showing another operation of the panel-loading support device for placing the outer panel on the panel receiver by an industrial robot or a manual labor.
Figure 6:
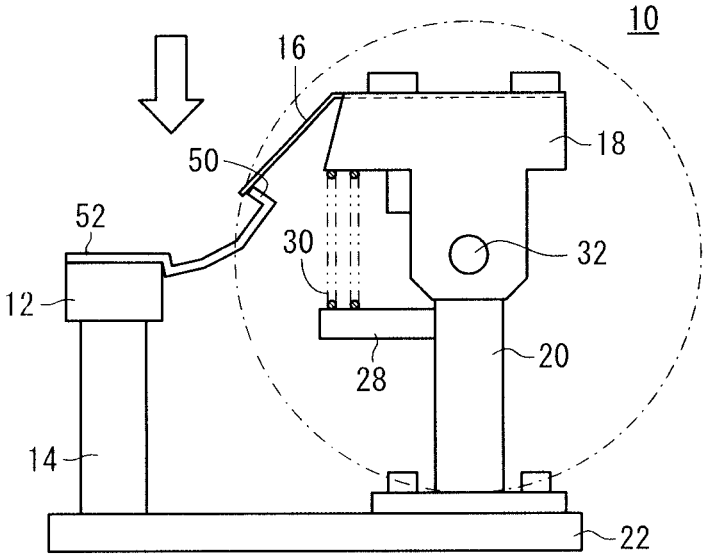
FIG. 6 is a view showing a further operation of the panel-loading support device for placing the outer panel on the panel receiver by an industrial robot or a manual labor.
Figure 7:
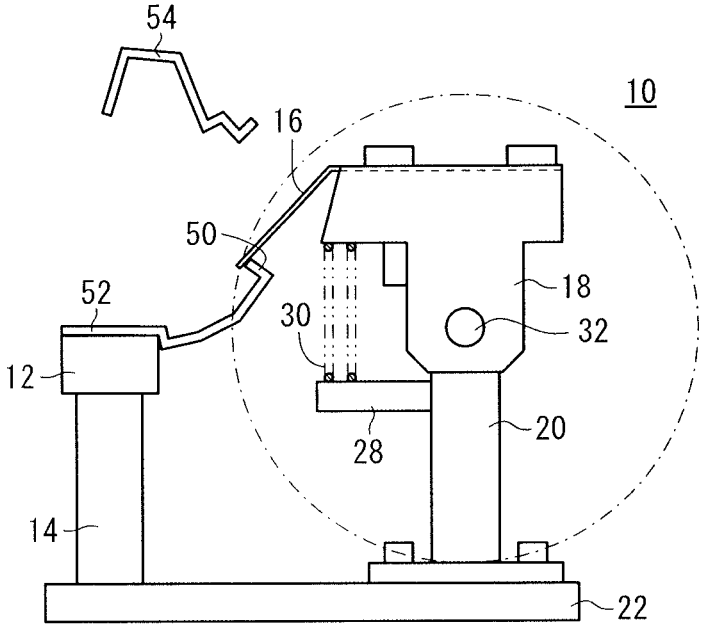
FIG. 7 is a view showing an operation of the panel-loading support device for loading an inner panel to the outer panel and overlapping the peripheries of the inner panel and the outer panel by an industrial robot or a manual labor.
Figure 8:
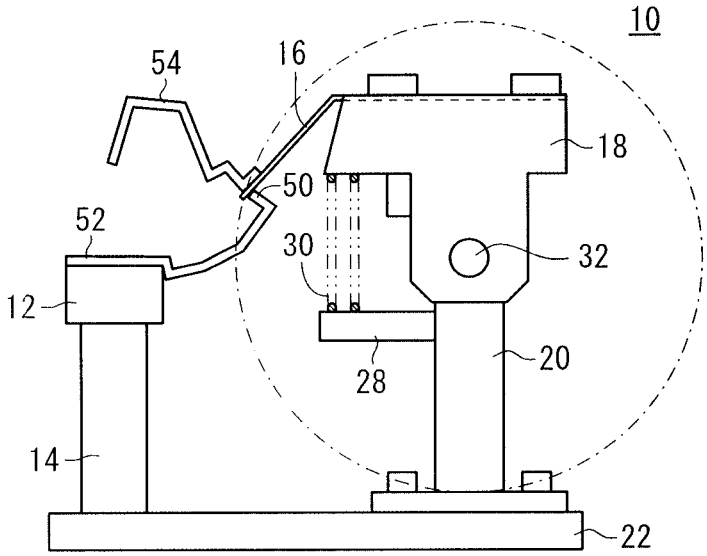
FIG. 8 is a view showing another operation of the panel-loading support device for loading the inner panel to the outer panel and overlapping the peripheries of the inner panel and the outer panel by an industrial robot or a manual labor.
Figure 9:
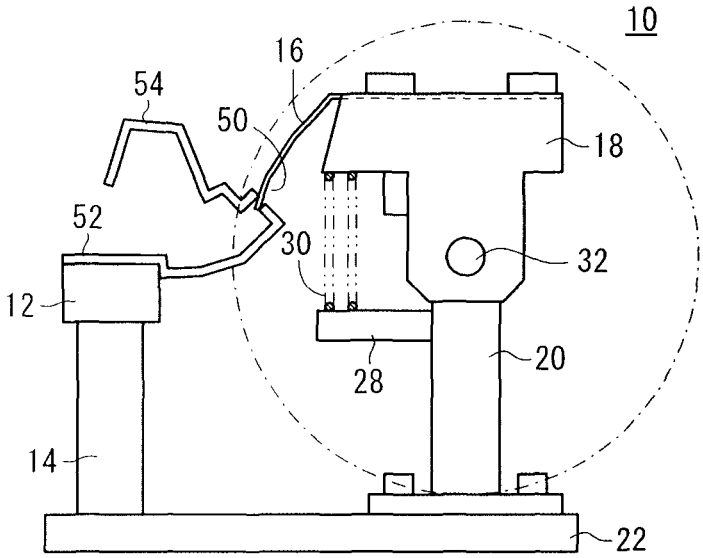
FIG. 9 is a view showing a further operation of the panel-loading support device for loading the inner panel to the outer panel and overlapping the peripheries of the inner panel and the outer panel by an industrial robot or a manual labor.
Figure 10:
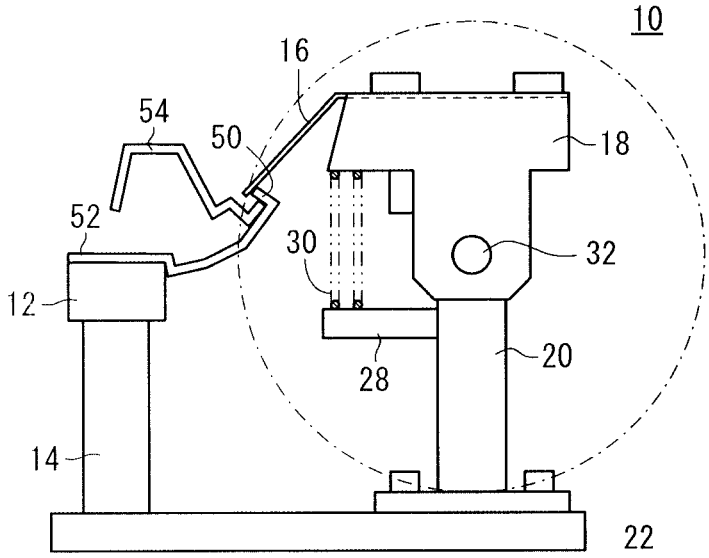
FIG. 10 is a view showing a still further operation of the panel-loading support device for loading the inner panel to the outer panel and overlapping the peripheries of the inner panel and the outer panel by an industrial robot or a manual labor.

FIGS. 4 to 6 illustrate operations of the panel-loading support device 10 when the outer panel 52 is placed on the panel receiver 12 by the industrial robot or the manual labor. The outer panel 52 touches the guide plate 16 before being placed on the panel receiver 12 (see FIG. 4). When the outer panel 52 is further descended, the guide plate 16 is pressed by the outer panel 52 to be curved (see FIG. 5). Subsequently, the outer panel 52 is placed on the panel receiver 12 (see FIG. 6). When the outer panel 52 is placed on the panel receiver 12, the guide plate 16 recovers its neutral state by the reaction force caused by the curving. At this time, the guide plate 16 is placed on or over the bent portion 50.

Then, the inner panel 54 is loaded onto the outer panel 52 from above the guide plate 16 by the industrial robot or manual labor to overlap the periphery of the outer panel 52 and an end of the inner panel 54. Specifically, the inner panel 54 is descended from above the guide plate 16 toward the outer panel 52 placed on the panel receiver 12 in order to load the inner panel 54 onto the outer panel 52. Then, with the aid of the guide plate 16, the inner panel 54 is inserted to the inside of the bent portion 50 to overlap the peripheries of the inner panel 54 and the outer panel 52, thus completing the loading of the inner panel 54 to the outer panel 52. At least one of the outer panel 52 and the inner panel 54 is provided by an elastic body. In this exemplary embodiment, the outer panel 52 is provided by an elastic body.

FIGS. 7 to 10 show the operation of the panel-loading support device 10 when the inner panel 54 is loaded onto the outer panel 52 to overlap the peripheries of the inner panel 54 and the outer panel 52 by the industrial robot or manual labor. Initially, when the inner panel 54 is descended toward the outer panel 52 from above the guide plate 16 (see FIG. 7), the inner panel 54 is in contact with the guide plate 16 (see FIG. 8). When the inner panel 54 is further descended, the guide plate 16 is curved to downwardly press the bent portion 50 of the outer panel 52 (an elastic body), thereby outwardly displacing the bent portion 50. Thus, an end of the inner panel 54 (i.e. an end that touches the bent portion 50) is smoothly inserted to the inside of the bent portion 50 (i.e. inside of the outer panel 52) (see FIG. 9). The panel receiver 12 disposed more remote from the bent portion 50 is more likely to cause an elastic deformation of the outer panel 52. Conversely, the panel receiver 12 disposed closer to the bent portion 50 is more likely to result in a plastic deformation of the inner panel 54. Accordingly, the panel receiver 12 is the more advantageously disposed away from the bent portion 50.

When the inner panel 54 is descended by an industrial robot or by a manual labor, the inner panel 54 is introduced to the inside of the bent portion 50 of the outer panel 52 by the guide plate 16. Then, the guide plate 16 restores its original shape by a reaction force caused by the curving, so that a periphery of the outer panel 52 is overlapped with the end of the inner panel 54 (see FIG. 10). Here, when the guide plate 16 is removed from between the outer panel 52 and the inner panel 54, the guide plate 16 recovers its original shape by the resilience thereof. At this time, the guide plate 16 is placed on or over the bent portion 50.

As shown in FIGS. 7 to 10, in loading the inner panel 54 to the outer panel 52, since the inner panel 54 can be introduced to the inside of the bent portion 50 of the outer panel 52 with the aid of the guide plate 16, the inner panel 54 can be easily loaded to the outer panel 52 without impairing the accuracy and rigidity of the hemming.

Figure 11:
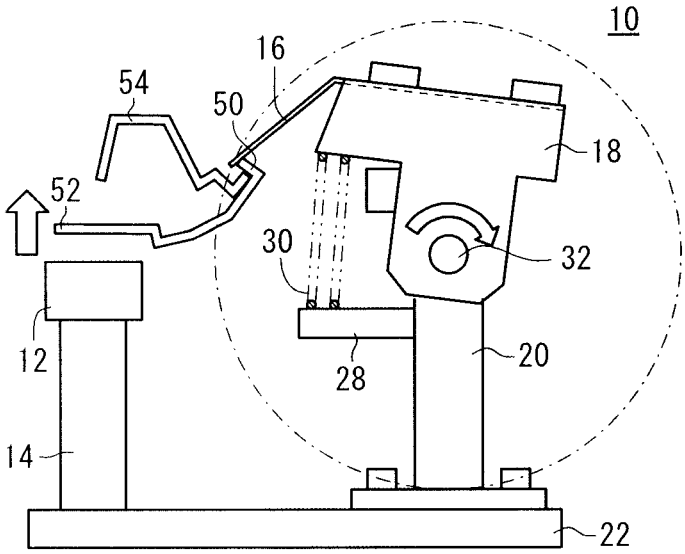
FIG. 11 is a view showing an operation of the panel-loading support device when the outer panel and the inner panel are lifted by an industrial robot or a manual labor.
Figure 12:
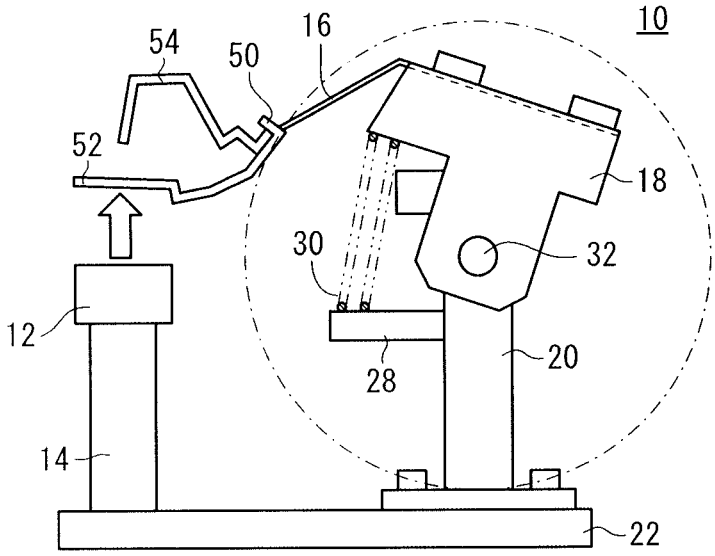
FIG. 12 is a view showing another operation of the panel-loading support device when the outer panel and the inner panel are lifted by an industrial robot or a manual labor.
Figure 13:
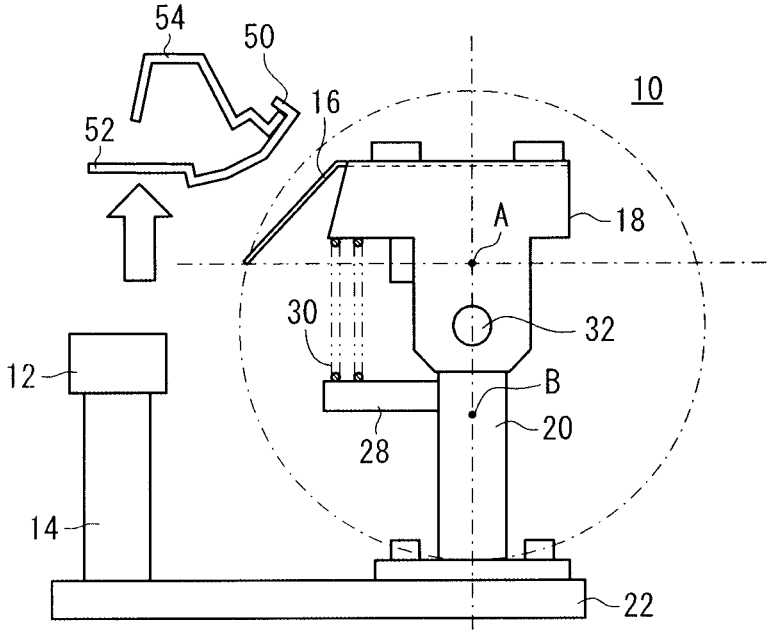
FIG. 13 is a view showing a further operation of the panel-loading support device when the outer panel and the inner panel are lifted by an industrial robot or a manual labor.

Then, the outer panel 52 and the inner panel 54 are moved upward (i.e. lifted) to remove the panels from the panel-loading support device 10 by the industrial robot or manual labor. FIGS. 11 to 13 show operations of the panel-loading support device 10 when the outer panel 52 and the inner panel 54 are ascended by the industrial robot or manual labor.

When the outer panel 52 and the inner panel 54 are ascended, the bent portion 50 touches the guide plate 16 to lift the guide plate 16 upward. Thus, a force is applied on the guide plate fixing portion 18 via the guide plate 16, so that the guide plate fixing portion 18 is turned rightward around the rotary shaft 32 (see FIG. 11). At this time, the spring 30 is stretched. When the outer panel 52 and the inner panel 54 are further ascended, further force is applied on the guide plate fixing portion 18 via the guide plate 16, which turns the guide plate fixing portion 18 to further rightward around the rotary shaft 32 to substantially retreat the guide plate 16 from the upward movement path of the outer panel 52 and the inner panel 54. The guide plate 16 becomes out of contact with the outer panel 52 as the outer panel 52 and the inner panel 54 are further ascended. Then, the guide plate fixing portion 18 returns to its neutral state by the contraction force of the spring 30 (see FIG. 13).

As described above, by placing the outer panel 52 on the panel receiver 12 so that the bent portion 50 is directed upward; placing the guide plate 16 on the bent portion 50; and loading the inner panel 54 to the outer panel 52 from above the guide plate 16, the inner panel 54 can be easily loaded to the outer panel 52 having the bent portion 50 without sacrificing the accuracy and rigidity of the hemming. Further, the inner panel 54 can be easily loaded even when the bent portion 50 of the outer panel 52 is acutely angled and loading of the inner panel 54 is difficult. Further, the inner panel 54 can be loaded to the outer panel 52 without damaging the outer pane 52 and the inner panel 54.

In addition, when the overlapped outer panel 52 and the inner panel 54 are moved upward to be removed from the panel-loading support device 10, since the guide plate 16 is retreated from the path of the outer panel 52 and the inner panel 54, the outer panel 52 and the inner panel 54 can be easily removed.

Figure 14:
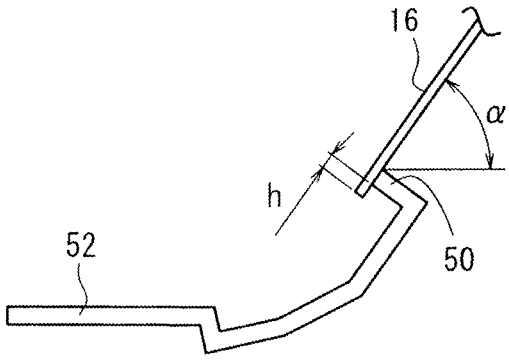
FIG. 14 is a view showing a relationship between the guide plate and a bent portion.

Next, the relationship between the guide plate 16 and the bent portion 50 will be described below. When the length h for the guide plate 16 to be projected from the bent portion 50 (see FIG. 14) is large, the guide plate 16 is held between the outer panel 52 and the inner panel 54 when the inner panel 54 is descended to the lowest position, so that the guide plate 16 cannot be returned to the neutral state (the state shown in FIG. 10). On the other hand, when the length h is short, the inner panel 54 cannot easily go into the inside of the outer panel 52. Accordingly, after various experiments, it has been proved that the length h is preferably in a range from 2 to 3 mm. Further, experiments also proved that an approach angle $\alpha$ of the guide plate 16 to the bent portion 50 affects the accessibility of the inner panel 54 to the inside of the outer panel 52. The approach angle of the guide plate 16 to the bent portion 50 is preferably in a range from 70 to 80 degrees (the closer to 80 degrees is the more preferable), according to the results of various experiments.

Further, when the rotary shaft 32 is located at a low position (e.g. at the position of the point B shown in FIG. 13), the rotation amount of the guide plate fixing portion 18 for retreat of the guide plate 16 is magnified. Accordingly, the rotary shaft 32 is advantageously disposed at the point A shown in FIG. 13. The position of the point A is an intersection of a horizontal line passing through the end (the first end) of the guide plate 16 and a vertical line passing through the center of the rotary shaft 32. Thus, the guide plate 16 can be retreated with a less amount of rotation.

The above-described exemplary embodiment may be modified as described below.

Figure 15:
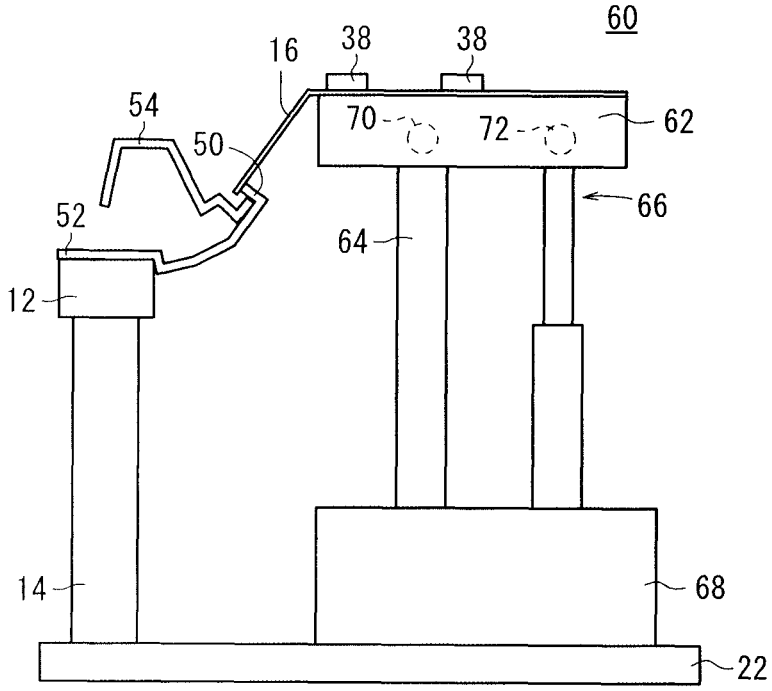
FIG. 15 is a view showing an operation of a panel-loading support device provided with a cylinder instead of a spring.
Figure 16:
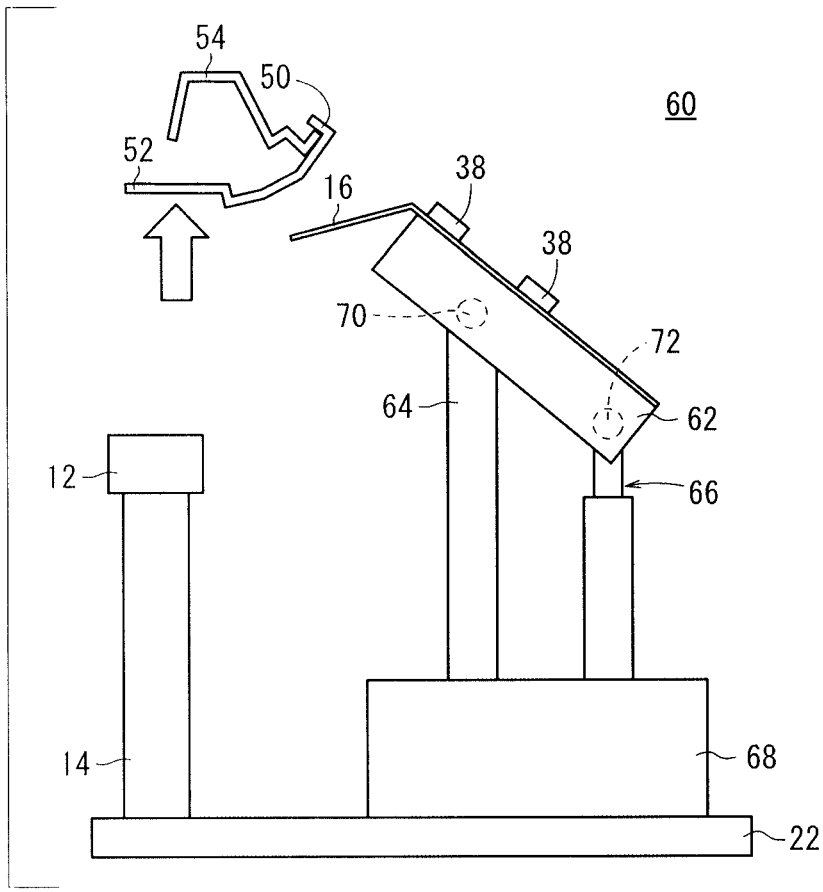
FIG. 16 is a view showing another operation of the panel-loading support device using a cylinder instead of a spring.
Figure 17:
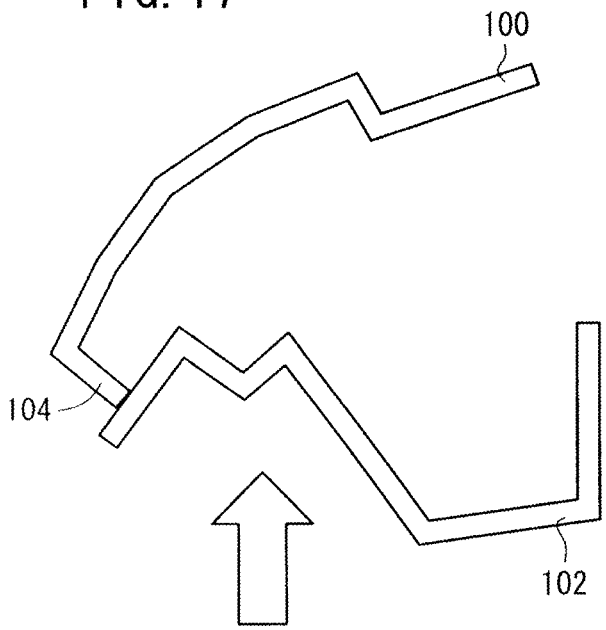
FIG. 17 is a view showing a problem when a parting line of a panel is positioned on a side orthogonal to a loading direction.
Figure 18:
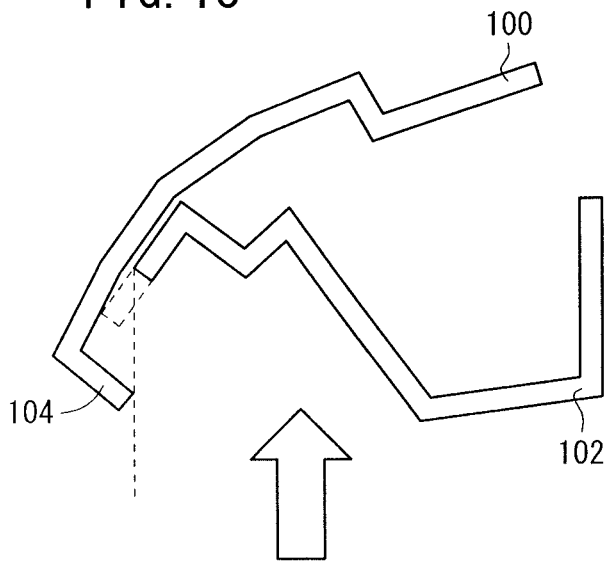
FIG. 18 is a view showing an exemplary method for solving the problem shown in FIG. 17.
Figure 19:
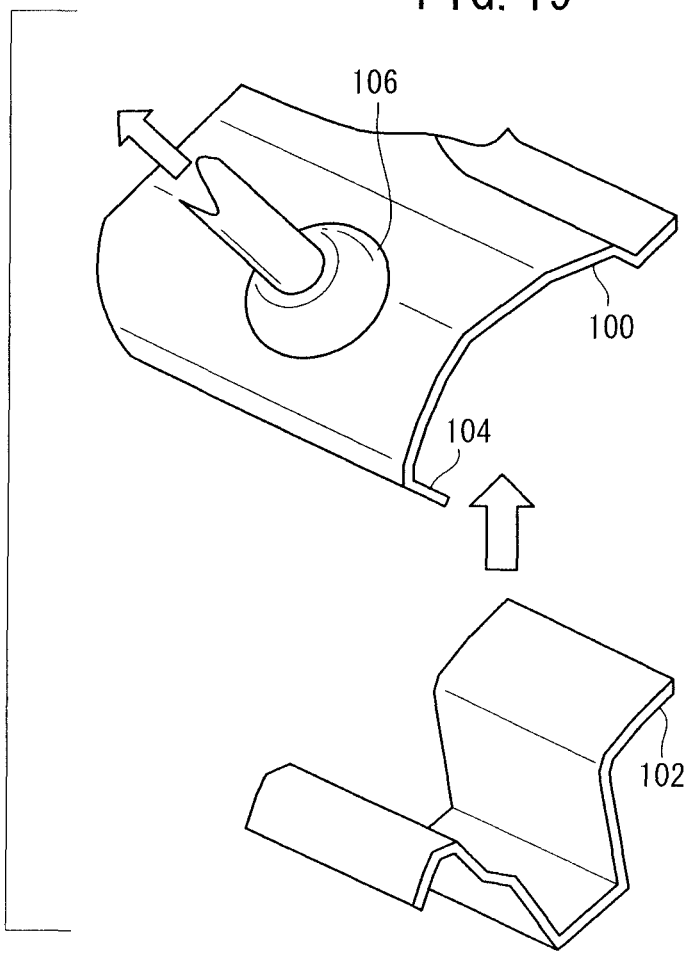
FIG. 19 is a view showing another exemplary method for solving the problem shown in FIG. 17.

(1) Though the rotated guide plate fixing portion 18 is returned by the spring 30 when the outer panel 52 and the inner panel 54 are removed from the panel-loading support device 10, a cylinder may be used instead of the spring 30. FIGS. 15 and 16 show operations of a panel-loading support device using a cylinder in place of the spring 30. FIG. 15 shows the panel-loading support device 60 when the inner panel 54 is completely loaded to the outer panel 52. FIG. 16 shows the panel-loading support device 60 when the outer panel 52 and the inner panel 54 are moved upward to be removed from the panel-loading support device 60.

The panel-loading support device 60 includes: the panel receiver 12, the first support 14; the base 22; the guide plate 16; the guide plate fixing portion 62; the second support 64; a cylinder 66; and a box portion 68. In the following description, the same or similar components as those shown in FIG. 1 will be denoted by the same reference numerals, and only the components different from those shown in FIG. 1 will be described. The box portion 68 is provided on the base 22 to support the second support 64 and the cylinder 66. The box portion 68 has a drive controller (not shown) for controlling the movement of the cylinder 66.

The second support 64 pivotally supports the guide plate fixing portion 62 so that the guide plate fixing portion 62 is capable of rotation around a rotary shaft 70. The cylinder 66 pivotally supports a guide plate fixing portion 62 so that the guide plate fixing portion 62 is capable or rotation around a rotary shaft 72. The rotary shaft 72 is slidable along the longitudinal direction of the guide plate fixing portion 62. The guide plate fixing portion 62 rotates around the rotary shaft 70. As shown in FIG. 2, the guide plate fixing portion 62 is provided with the recess 36 for adjusting the height of the second end of the guide plate 16. The height of the second end of the guide plate 16 can be adjusted by inserting the adjuster plate 34 in the recess 36. The guide plate 16 is fixed on the guide plate fixing portion 62 by the bolts 38, 38.

As shown in FIG. 15, until the outer panel 52 is completely loaded to the panel receiver 12, the first end of the guide plate 16 is located on or above the predetermined point by the cylinder 66. When the inner panel 54 is loaded and the outer panel 52 and the inner panel 54 are to be moved upward, as shown in FIG. 16, the above-described drive controller contracts the cylinder 66 to turn the guide plate fixing portion 62 rightward around the rotary shaft 70, thereby retreating the guide plate 16 from the path of the outer panel 52 and the inner panel 54. Incidentally, since the operation of the panel-loading support device 60 until the inner panel 54 is completely loaded to the outer panel 52 is the same as the above-described exemplary embodiment, the description is omitted.

(2) Though the guide plate 16 is retreated from the path of the outer panel 52 and the inner panel 54 by the rightward rotation of the guide plate fixing portion 18 around the rotary shaft 32, the guide plate 16 may be retreated in another way. For instance, the second support 20 may be turned around a vertical axis thereof to horizontally move the guide plate fixing portion 18 to retreat the guide plate 16.

The exemplary embodiment of the invention has been described above. However, it should be noted that the technical scope of the invention is not limited to the above exemplary embodiment. It is clear to those skilled in the art to make various modifications or improvements to the above-described exemplary embodiment. Any embodiment bearing such modifications or improvements can be included in the technical scope of the invention as mentioned in the claims below.

What is claimed is:

1. A panel loading method for loading an inner panel to an outer panel that has a bent portion provided by bending a periphery thereof, the outer panel and the inner panel being overlapped to integrate the outer panel and the inner panel at the peripheries thereof, the method comprising the steps of:

providing the outer panel as an elastic body;

placing the outer panel on a panel receiver so that the bent portion is directed upward;

placing an elastic guide plate on or above the bent portion;

loading the inner panel to the outer panel by lowering the inner panel from above the guide plate such that the inner panel contacts the guide plate to outwardly press the bent portion of the outer panel outward through the guide plate; and inserting the inner panel into an inside of the bent portion of the outer panel.

2. The panel loading method according to claim 1, further comprising:

moving the outer panel and the inner panel upward; and when the outer panel and the inner panel are moved upward, retreating the guide plate from a path of the outer panel and the inner panel in accordance with the upward movement of the outer panel and the inner panel.

* * * * *